US005711092A

United States Patent [19]

Despres et al.

[11] Patent Number: 5,711,092

[45] Date of Patent: Jan. 27, 1998

[54] JOINTED BENDABLE FOOT PROTECTOR FOR USE WITH A SHOE

[76] Inventors: Richard L. Despres, 279 Luce, Grand Rapids, Mich. 49504; Joseph G. Dell, R.R. 1, Box 228, Stormville, N.Y. 12582

[21] Appl. No.: 482,802

[22] Filed: Jun. 7, 1995

Related U.S. Application Data

[63] Continuation-in-part of Ser. No. 294,567, Aug. 23, 1994, abandoned.

[51] Int. Cl.[6] ..... A43B 13/22; A43B 23/26; A43B 5/00

[52] U.S. Cl. ..... 36/72 R; 36/54; 36/133

[58] Field of Search ..... 36/54, 72 R, 132, 36/136, 133, 88, 96, 107, 114, 115, 7.1 R, 77 R

[56] References Cited

U.S. PATENT DOCUMENTS

| | | | |
|---|---|---|---|
| 776,767 | 12/1904 | Waters . | |
| 1,053,555 | 2/1913 | Berg | 36/72 R |
| 1,171,582 | 2/1916 | Bertona . | |
| 1,535,207 | 4/1925 | Dorff . | |
| 1,806,975 | 5/1931 | Johnson | 36/72 R |
| 2,396,867 | 1/1946 | Stoner et al. | 36/72 R |
| 2,555,900 | 6/1951 | Roberts | 36/72 R |
| 2,615,261 | 10/1952 | Grotto | 36/72 R |
| 2,833,058 | 5/1958 | Wilmanns et al. | 36/72 R |
| 2,851,798 | 9/1958 | Phillips | 36/72 R |
| 3,006,086 | 10/1961 | Bird, Jr. | 36/72 |
| 3,037,304 | 6/1962 | Duffy | 36/72 R |
| 3,068,593 | 12/1962 | O'Donnell | 36/72 |
| 3,082,553 | 3/1963 | Wilmanns | 36/72 |
| 3,102,347 | 9/1963 | Griswold et al. | 36/72 R |
| 3,175,310 | 3/1965 | MacQuaid | 36/72 R |
| 3,252,232 | 5/1966 | Smith | 36/72 R |
| 3,334,427 | 8/1967 | Edwards et al. | 36/72 R |
| 3,407,518 | 10/1968 | MacQuaid et al. | 36/72 R |
| 3,841,004 | 10/1974 | Gray et al. | 36/72 R |
| 3,995,382 | 12/1976 | Smith | 36/72 R |
| 4,051,612 | 10/1977 | Damron | 36/72 R |
| 4,231,170 | 11/1980 | Griswold | 36/72 R |
| 4,967,493 | 11/1990 | Mues | 36/72 R |
| 5,251,386 | 10/1993 | Diaz | 36/72 R |

FOREIGN PATENT DOCUMENTS

| | | | |
|---|---|---|---|
| 830913 | 2/1952 | Germany | 36/72 R |
| 2027661 | 12/1971 | Germany | 36/72 R |

*Primary Examiner*—B. Dayoan

*Attorney, Agent, or Firm*—Waters & Morse, P.C.

[57] ABSTRACT

A foot protector is disclosed herein. The foot protector comprises an upper shield, suitable for conforming to, covering and protecting the metatarsal or middle portion of the foot; an anterior shield, suitable for conforming to, covering and protecting the phalanges or toe portion of the foot; and a flexible joint which connects the two shields and allows for substantially normal foot motion. The foot protector may be used on cleated athletic footwear, such as those worn by football players, to prevent foot injuries without hindering athletic performance. The foot protector may be equipped with eyelets on the upper shield and a strap or laces on the anterior shield as a means of securing the device to the underlying shoe.

42 Claims, 5 Drawing Sheets

JOINTED BENDABLE FOOT PROTECTOR FOR USE WITH A SHOE

This application is a continuation-in-part of application Ser. No. 08/294,567, filed Aug. 23, 1994, now abandoned.

BACKGROUND OF THE INVENTION

1. Technical Field

The present invention generally relates to foot protectors. More particularly, the present invention relates to foot protectors capable of being worn over cleated athletic shoes without substantially hindering athletic performance.

2. Background Art

Foot protection continues to be a recognizable concern for athletes participating in contact sports such as football. The risk of painful injury resulting from a step-on incident remains quite high due to the lack of adequate protection. This is particularly the case in sports like football where spiked cleats are often worn by the athletes.

Today's standard football uniform attempts to protect every part of the body except the top of the foot. One reason for this is that the athletes are required to perform at a high level and therefore can not be hindered by a lack of foot mobility.

Until now, no device has existed which would provide foot protection without hindering performance or comfort. Furthermore, no device has allowed for the necessary foot movement or mobility without adding significant weight, bulk and awkwardness.

The majority of the prior art which does exist in this field use a one piece shield to cover a portion of a shoe. While such designs may be suitable for footwear worn by someone involved in the construction industry, such designs are not suitable for athletes either because the shield hinders foot mobility or because the shield does not adequately cover the entire top of the foot.

Moreover, other existing devices which incorporate more complex designs in an attempt to provide the needed flexibility and protection are not fully conforming and are therefore prone to dirt and debris build-up under the protector. Finally, no device exists which can provide all of the required features plus remain securely attached to the underlying shoe during the extremely rigorous foot movements found in sports like football.

Thus, a need exists for a foot protector which will protect an athlete from painful step-on injuries while providing a high degree of flexibility and mobility such that the athlete's performance will not be significantly hindered.

SUMMARY OF THE INVENTION

Briefly, the present invention satisfies the need for foot protection for athletes by providing a device which conforms to the top of an underlying shoe and will flex with the foot, thus allowing significant coverage of the foot without sacrificing performance due to reduced mobility. The present invention may also be used to provide foot protection in industry.

The present invention comprises an upper or posterior shield, which covers and protects the middle section (e.g. the metatarsal region) of the foot, an anterior shield which covers and protects the toe portion (e.g. the phalanges) of the foot, and a flexible joint which connects the upper shield to the anterior shield. The flexible joint compresses and expands as needed to allow for full and natural foot motion. When the middle section of the foot is flexed forward, the upper shield will translate forward and downward, under the anterior shield, likewise, when the toes of the foot are flexed upward, the anterior shield will translate upward and rearward, above the upper shield.

In one aspect of the invention, the flexible joint comprises a flexible membrane that is configured to create a neutral zone at two separate locations along the joint, with the neutral zones defining a pivot area, about which the upper and the anterior shields rotate.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
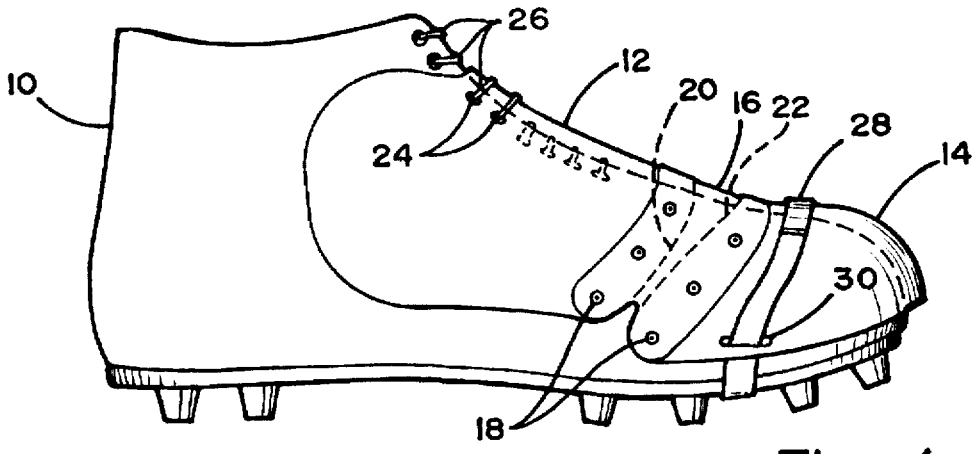
FIG. 1 depicts a side view of an athletic shoe with a foot protector in accordance with the present invention attached thereto.

Referring to FIG. 1, a side view of a foot protector is shown attached to an athletic shoe 10 in the neutral position. Although the description herein refers to one foot protector, it is understood that typically one foot protector of a pair of foot protectors will be configured to be placed upon a right shoe and another will be configured to be placed upon the left shoe. The foot protector substantially conforms to the shape of the top and sides of a shoe 10 and utilizes upper (or posterior) shield 12 and anterior (or toe) shield 14 as protective devices. Flexible joint 16 connects upper (or metatarsal) shield 12 to anterior shield 14. It is recognized that different shield and joint configurations may be used depending on such factors as the shoe size and shape and performance requirements. Thus, FIG. 1 depicts only one possible design.

Flexible joint 16 acts as a hinge that allows both upper shield 12 to flex radially forward and anterior shield 14 to flex radially upward. In the preferred embodiment, flexible joint 16 is a translational rotational joint which enables shields 12 and 14 to pivot relative to each other about a neutral area instead of a fixed point. In order to provide adequate flexibility, flexible joint 16 should be capable of varying the area where upper shield 12 pivots relative to anterior shield 14. Constructing the flexible joint 16 from a flexible, yet durable material such as nylon, rubber or leather flexible fabric should provide the desired relative movement between shields 12 and 14. In one embodiment, flexible joint 16 extends over both shields 12 & 14 and is attached thereto by rivets 18. The dotted line 20 indicates the lower edge of upper shield 12 which is hidden by flexible joint 16. Likewise, dotted line 22 indicates the upper edge of anterior shield 14 and is also hidden by flexible joint 16. When the foot is in the neutral position there may be an area between the shields filled by the flexible joint 16 where the edges of the shields do not contact one another. This area or space may be widest at the midpoint of the connection between the upper shield 12 and the anterior shield 14 to allow for greater relative movement at that point. Furthermore, this area or space may have an open-ended elliptical shape, as shown by the dotted lines 53 and 55 of FIG. 5 which indicate the lower edge of upper shield 52 and the upper edge of anterior shield 54, respectively. The larger the flexible area between the shields 12 and 14 filled by the flexible joint 16, (FIG. 1) the greater the flexibility of the foot. Other methods of attaching flexible joint 16 to shields 12 & 14 include, but are not limited to, glue 23 (FIG. 5), stitching 25 (FIG. 6), lacing consisting of lace openings 27 and lace 29 (FIG. 13), heat sealing and/or any combination thereof.

Pursuant to this design, flexible joint 16 allows for expansion and contraction of shields 12 & 14 so that an individual wearing the foot protector can substantially perform all of his or her natural foot motions while receiving superior foot protection. This is of particular importance to many athletes, who although susceptible to foot injuries from foreign impact, are required to run and perform at a high level.

The foot protector may either be permanently attached to the shoe or be attachable. In this preferred embodiment, the foot protector is attachable. Eyelets 24 and strap 28 provide the means for attaching the device. The number of eyelets used will depend on shield size and function.

To attach the foot protector, shoe lace 26 is fed through eyelets 24 in order to secure upper shield 12 to the top middle section of shoe 10. The foot protector is further attached with strap 28, which secures anterior shield 14 to the toe portion of shoe 10. Strap 28 passes through slit 30, wraps around the bottom of the shoe, back up through a slit on the opposite side (not shown) and fastens to itself on the top of anterior shield 14. Suitable methods of fastening strap 28 to itself include, but are not limited to, a buckle or hook and loop material such as VELCRO.

This design also provides easy accessibility to the underlying shoe laces. When anterior shield 14 is secured to shoe 10 with strap 28 or laces (FIG. 12) and upper shield 12 is not secured, upper shield 12 may be flexed forward by hand for complete access to shoe lace 26.

Figure 2:
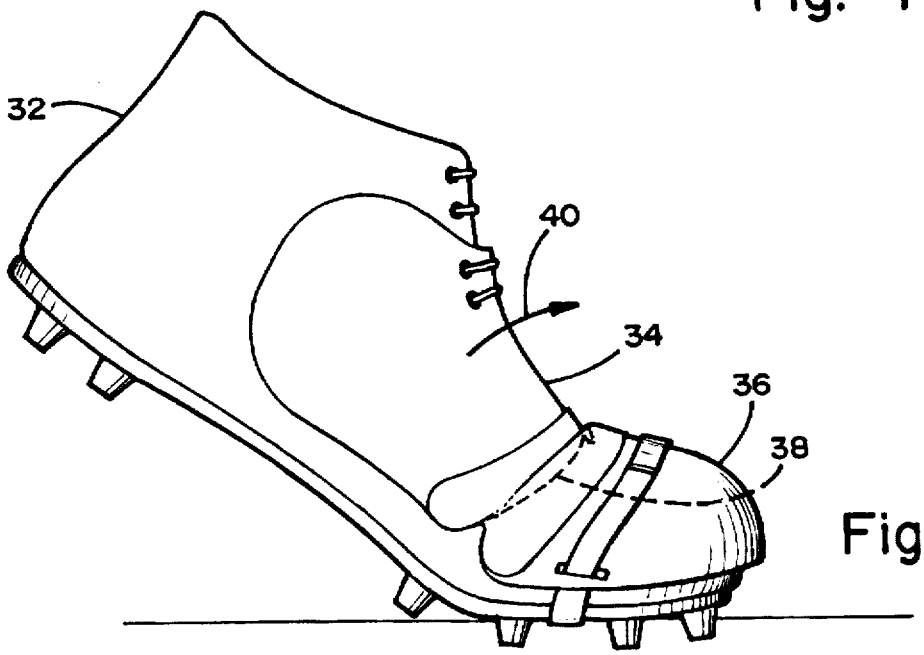
FIG. 2 depicts a side view of an athletic shoe with a foot protector in a forward flexed position in accordance with the present invention attached thereto.

Referring now to FIG. 2, the foot protector is shown on shoe 32 in the flexure position. In this figure, the foot is flexed radially forward (see arrow 40) so that only the toe portion of the shoe remains implanted on the ground. This represents a common position realized by the foot while walking or running.

In this position, upper shield 34 flexes radially forward while anterior shield 36 remains unchanged from the neutral position. Upper shield 34 may translate beneath anterior shield 36, especially during full flexure, in one embodiment of the present invention. Dotted line 38 indicates the lower edge of upper shield 34 which may slide under anterior shield 36, thus allowing for full, uninhibited foot extension. In other embodiments, there is a sufficient space between the upper shield 34 and the anterior shield 36 such that no overlap occurs during flexure.

Figure 3:
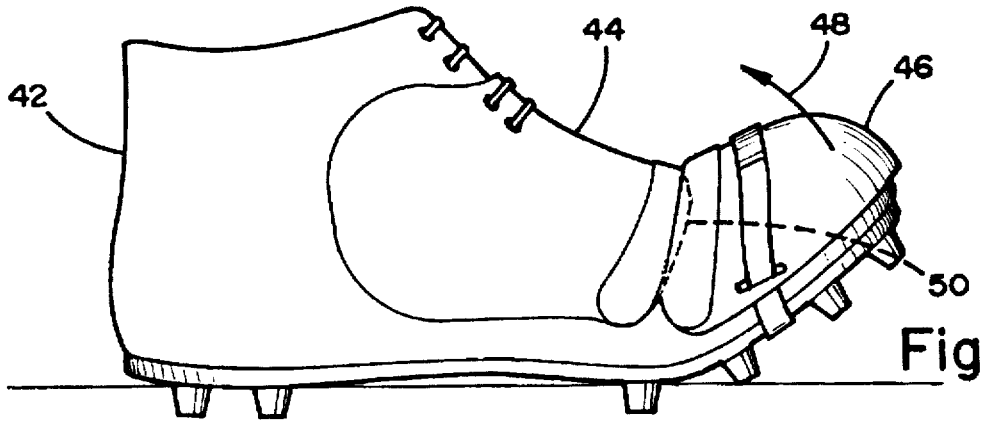
FIG. 3 depicts a side view of an athletic shoe with a foot protector in a "toe up" flexed position in accordance with the present invention attached thereto.

Referring now to FIG. 3, the foot protector is shown on shoe 42 with toes of the foot extended radially upward. This position is similar to that shown in FIG. 2 except here the toe portion of shoe 42 is raised off of the ground while the remainder of shoe 42 remains implanted.

In this situation, anterior shield 46 flexes radially upward (see arrow 48) while upper shield 44 remains unchanged from the neutral position. As mentioned above, anterior shield 46 may roll over upper shield 44, especially during full flexure, in one embodiment of the present invention. Dotted line 50 demonstrates that, in this foot position, the lower edge of upper shield 44 may translate beneath anterior shield 46 just like it did in FIG. 2. In other embodiments, there is a sufficient space between the upper shield 44 and the anterior shield 46 such that no overlap occurs during flexure.

Figure 4:
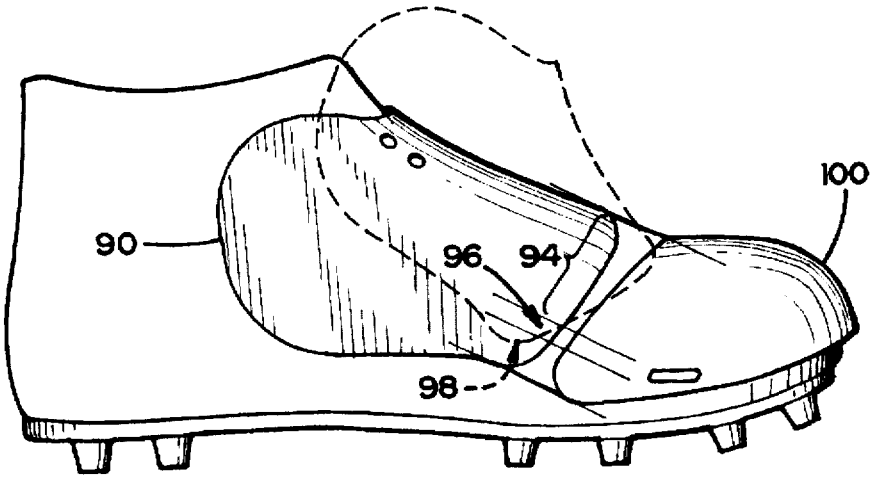
FIG. 4 depicts a side view of the foot protector in accordance with the present invention with the upper shield shown in the neutral and flexed positions.

Referring now to FIG. 4, a side view of the foot protector is shown with the upper shield in both the neutral position 90 (solid line) and the flexure position 92 (dotted line) to specifically demonstrate the dynamics of the flexible joint. Within the region where the flexible joint operates, three zones of movement exist, the compression zone 94, the neutral zone 96, and the expansion zone 98.

While the compression zone 94, the neutral zone 96 and the expansion zone 98 are shown relative to only one side of the foot protector in the side elevational view of FIG. 4, one having ordinary skill in the art will understand the symmetry of the foot, and the symmetry of the foot protector. One will also understand, then, that the compression zone 94 extends over the shoe 10, and that a second one of each of the neutral zone 96 and the expansion zone 98 is located on the far side of the foot protector, opposite the ones seen in FIG. 4.

When the foot protector translates from the neutral position to the flexure position, each of the three zones 94, 96 & 98 react in the following manner. First, the portion of the upper shield associated with the compression zone 94 moves closer to the anterior shield 100. Thus, in the compression zone 94, the flexible joint is compressed as the shields translate toward each other. Next, the portion of the upper shield associated with the neutral zone 96 remains substantially at the same distance to the anterior shield. Thus, in the neutral zone 96, the flexible joint remains substantially unchanged and the shields remain essentially fixed in position. Finally, the portion of the upper shield associated with the expansion zone 98 moves away from the anterior shield 100. Thus, in the expansion zone 98, the flexible joint expands as the shields translate away from each other. These different regions of movement give the foot protector the ability to flex like a foot while remaining substantially conformed to the top of the underlying shoe.

An alternate design may be achieved by eliminating that part of the upper shield which is associated with the expansion zone. Thus, the upper shield would connect at the joint area at or near the neutral zone. This would eliminate the need to cover the expansion zone.

Figure 5:
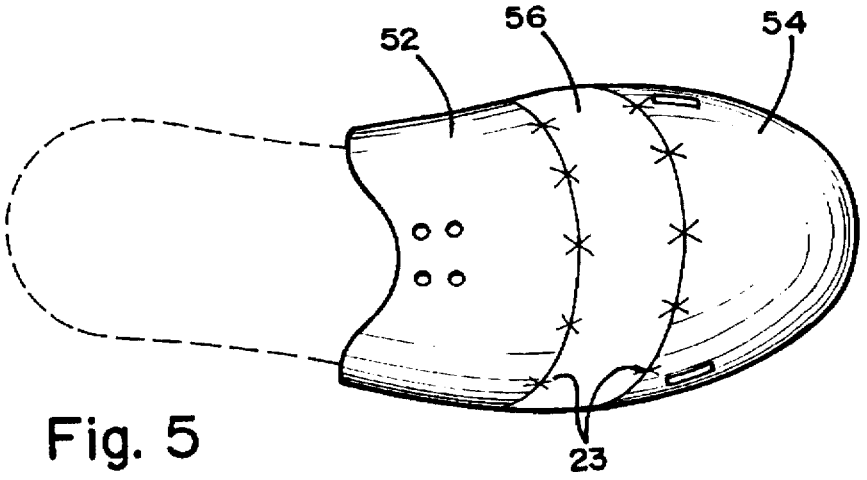
FIG. 5 depicts a top view of the foot protector in accordance with the present invention.
Figure 6:
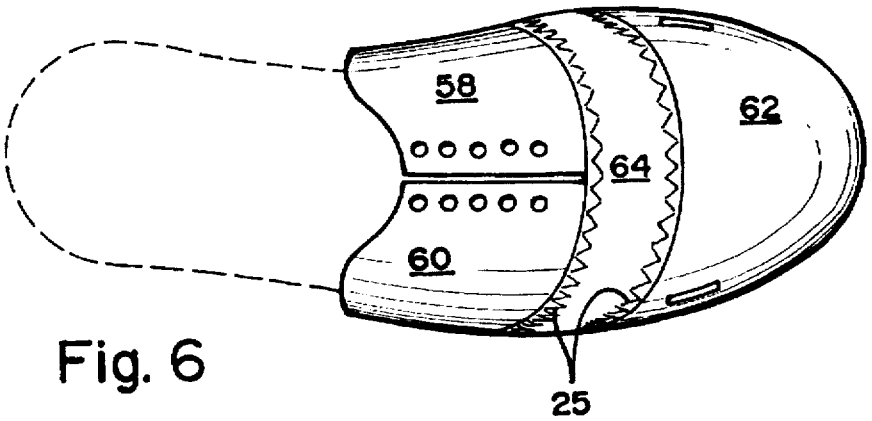
FIG. 6 depicts a top view of an alternate design of the foot protector in accordance with the present invention.

Referring now to FIGS. 5 and 6, top views of the above described embodiment (FIG. 5) and an alternate design (FIG. 6) are shown. FIG. 5 depicts the double shield embodiment (as described above) comprising an upper shield 52, an anterior shield 54 and a flexible joint 56. FIG. 6 depicts a triple shield embodiment. In FIG. 6, anterior shield 62 and flexible joint 64 remain substantially unchanged while the upper shield is split into two pieces, left upper shield 58 and right upper shield 60.

Figure 7:
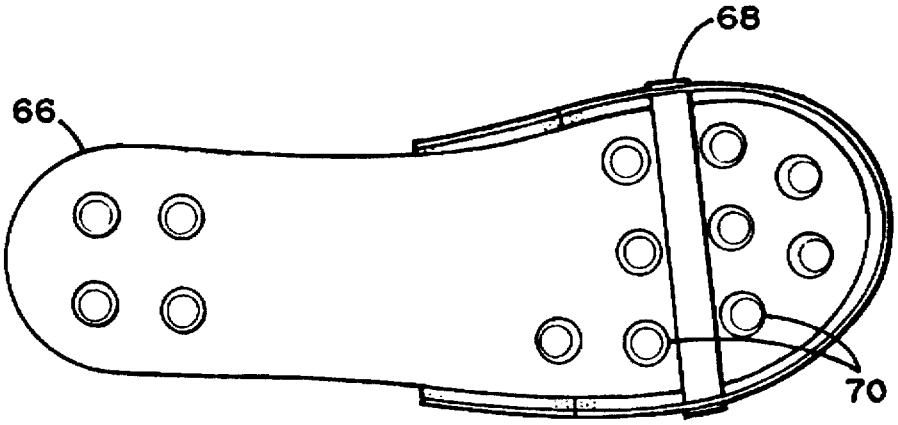
FIG. 7 depicts a bottom view of an athletic shoe with the foot protector in accordance with the present invention attached thereto.
Figure 8:
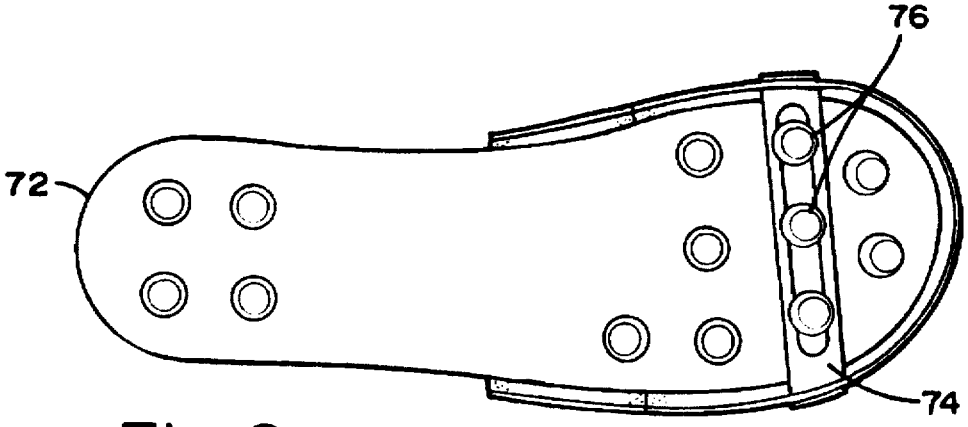
FIG. 8 depicts a bottom view of an athletic shoe with the foot protector in accordance with the present invention attached thereto.

Referring now to FIGS. 7 and 8, the bottom of cleated shoes 66 and 72 are shown with two possible strap configurations. FIG. 7 shows a strap configuration wherein strap 68 passes between the cleats 70 on the bottom of shoe 66. FIG. 8 shows a strap configuration wherein strap 74 either cradles cleats 76 or is attached to cleats 76 on the bottom of shoe 72. Both embodiments use a strap which may be flat and thin so as to not interfere with walking or running. The strap may be made from nylon or other suitable material. The strap may be made of a 20 stretchable material such as rubber, and/or may be adjustable in length by use of hook and loop material such as VELCRO or the like.

Figure 9:
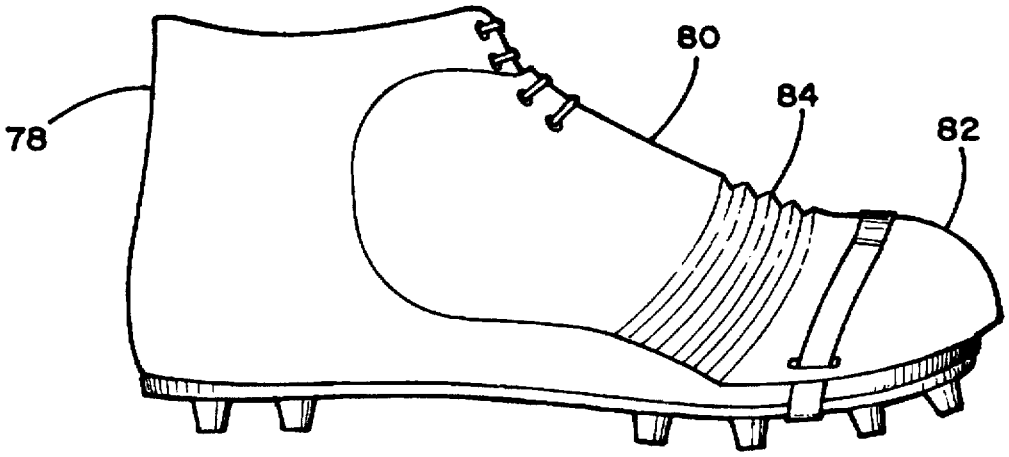
FIG. 9 depicts a side view of an athletic shoe with an alternate design of the foot protector in accordance with the present invention attached thereto.
Figure 10:
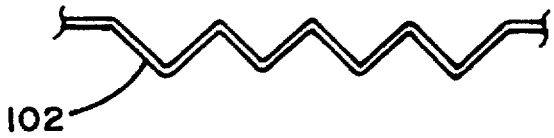
FIG. 10 depicts a cross sectional side view of the living hinge described in FIG. 9.

Referring now to FIG. 9, an alternate uni-body design for the foot protector is shown on shoe 78. In this alternate design, upper shield 80, anterior shield 82 and flexible joint 84 are all constructed from a single piece of material such as plastic. The joint function 84 of this design may be achieved through the use of bellows and/or living joints. FIG. 10 shows a cross sectional side view of such a living joint. The joint comprises a plurality of living hinges 102 which allows the joint area to compress and expand. The same type of flexibility can be achieved for the uni-body foot protector as that of the conventional foot protector (see FIGS. 1–6) by designing the living hinge to flex only in the desired directions. All other design criteria remain the same for this design.

Figure 11:
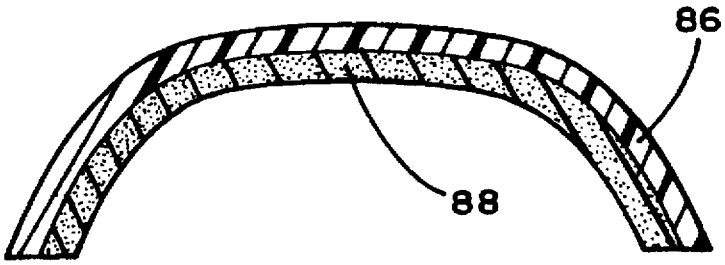
FIG. 11 depicts a cross sectional view of a shield usable in the foot protector constructed in accordance with the present invention.

FIG. 11 shows a cross-sectional view of a possible combination of materials used in both the upper and anterior shields. The shields comprise an outer shell or layer 86 attached to an impact absorbent under layer 88. Depending on the particular shield design, the impact absorbent under layer 88 may or may not cover the entire under side of the outer shield 86. The two components may be attached by glue or other interfacing material or method.

Figure 12:
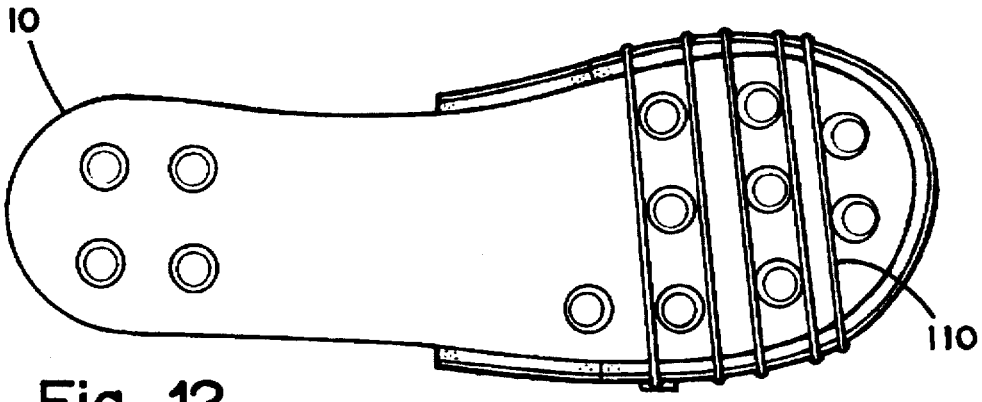
FIG. 12 depicts a bottom view of the athletic shoe with the foot protector of the present invention attached to the shoe by means of a shoelace.
Figure 13:
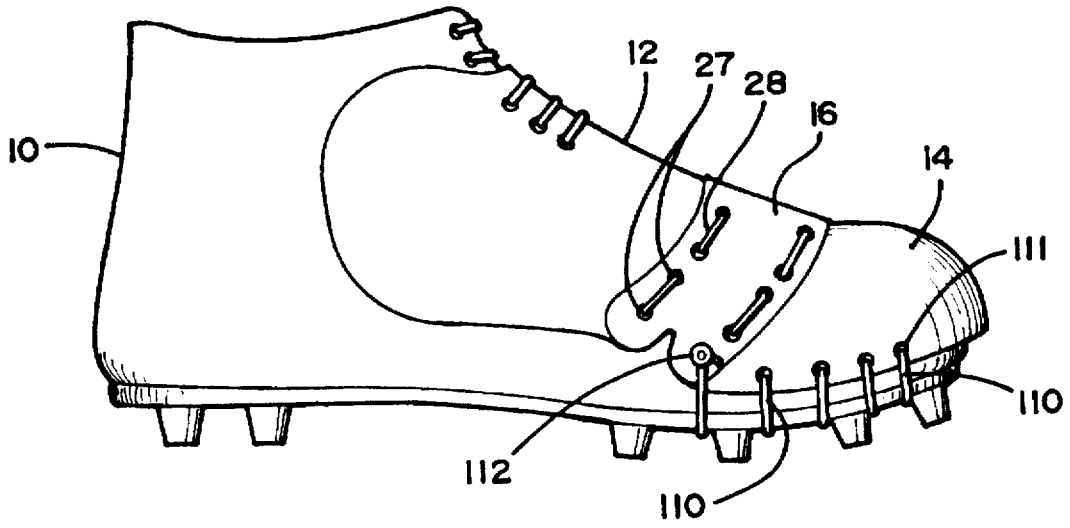
FIG. 13 depicts a side view of the athletic shoe with the foot protector of the present invention attached to the shoe by means of a shoe lace.

Referring to FIGS. 12 and 13, the bottom and side of a cleated shoe 10 show an alternate attachment configuration for the anterior shield. FIG. 13 shows a lace configuration whereby a lace 110 passes through lace openings 111 located on one side of the shield at the bottom lateral perimeter, then passes laterally across the bottom of the shoe to similarly (not shown) placed lace openings on the other side of the shied.

This lace may pass passively along side of existing cleats or may be attached to or secured under the cleats whenever these cleats are removable, for additional support and stability.

This lace is tightened as desired for comfort and stability and may itself be secured by a molly clamp 112 or similar such attachment device.

Figure 14:
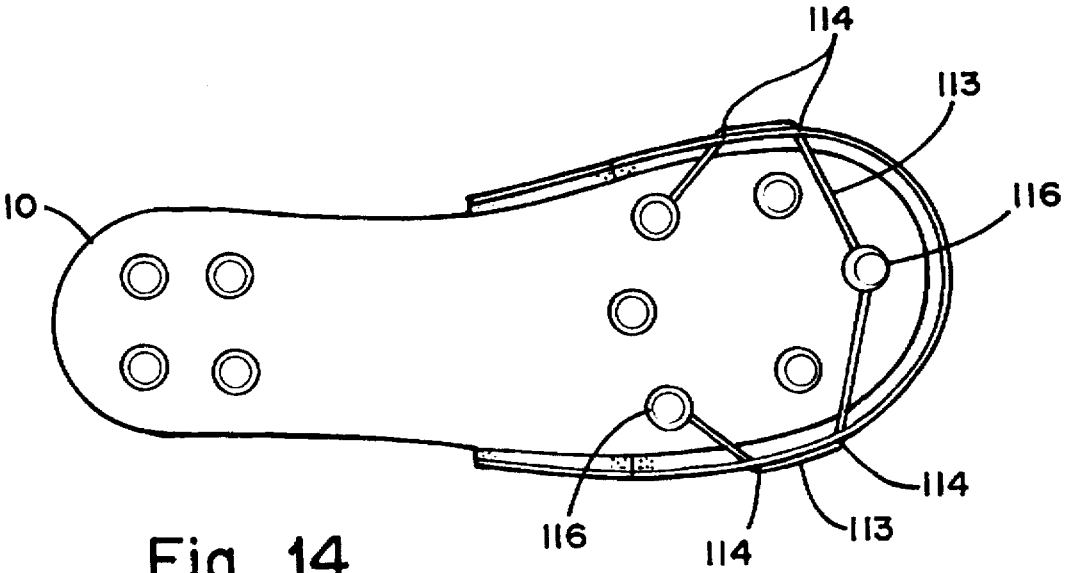
FIG. 14 depicts a bottom view of the preferred lace configuration.

FIG. 14 shows the preferred lace configuration for attachment of the anterior shield to a cleated shoe 10. Lace 113 passes through lace openings 114 located on the bottom lateral perimeter of each side of the shield and has it ends and middle secured to the bottom of the shoe by attachment to cleats 116. In one embodiment, this attachment is achieved by screwing cleats 116 to shoe 10 with lace 113 positioned therebetween.

The outer shell may be constructed from a semi-rigid material with elastic and plastic properties, such as PVC or polyethylene plastic. Such material would ideally be light weight, shatter proof, and impact dissipating.

The impact absorbent under layer 88 may be made from an air entrained polyethylene, an air entrained neoprene, any other suitable foam rubber material or any combination thereof. For instance, since air entrained neoprene has a firm texture, that material may be used at the top of the metatarsal area, while the more collapsible air entrained polyethylene may be used near the edges.

Although the above description of the present invention is directed to foot protection for athletes, it should be noted that the present invention also has various industrial applications. In this capacity, the present invention is a cost effective alternative to steel-toed shoes and provides workers with increased foot mobility and comfort. For these industrial applications, the outer shell of the foot protector may be constructed of metal.

In sum, the present invention provides substantial foot protection without any significant loss of foot mobility. This is achieved by providing an upper shield which covers and protects the middle section of the foot; an anterior shield which covers and protects the toe portion of the foot; and a flexible joint which connects the two shields and allows each shield to flex independently as the foot requires.

Additional features of the invention include eyelets on the upper shield allowing it to be secured with the underlying shoelace and a strap or laces on the anterior shield allowing it to be firmly secured to the toe portion of the shoe.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

We claim:

1. A foot protector for use with a shoe, comprising:

an upper shield having a stiff outer layer and an impact absorbent underlayer bonded to an underside of said upper shield, said upper shield being shaped to conform to, cover and protect that portion of the shoe housing the metatarsal region of a foot;

an anterior shield having a stiff outer layer and an impact absorbent underlayer bonded to an underside of said anterior shield, said anterior shield being shaped to conform to, removedly cover and protect the toe portion of the shoe within which the phalanges region of said foot is located;

a flexible joint connecting said upper shield to said anterior shield to enable said upper shield to independently flex radially forward and said anterior shield to independently flex radially upward, said flexible joint being constructed of a flexible material and configured to create a neutral zone at two separate locations along said joint, said neutral zones defining a pivot area about which said upper shield and said anterior shield are able to pivot, thereby allowing said foot the freedom to move in a substantially natural manner.

2. The foot protector of claim 1 wherein said foot protector substantially conforms to the top and sides of the shoe to enable said foot protector to be worn there upon.

3. The foot protector of claim 1 wherein a lower edge of said upper shield translates beneath a top edge of said anterior shield only when said upper shield is flexed radially forward.

4. The foot protector of claim 1 wherein a top edge of said anterior shield translates above a lower edge of said upper shield only when said anterior shield is flexed radially upward.

5. The foot protector of claim 1 wherein said outer layer of said upper and anterior shields is comprised of one of plastic and metal.

6. The foot protector of claim 1 wherein said under layer of said upper and anterior shields is comprised of one of air-entrained polyethylene, air-entrained neoprene, and rubber.

7. The foot protector of claim 1 wherein said flexible joint is comprised of one of a flexible fabric, nylon, and rubber.

8. The foot protector of claim 1 wherein said flexible joint is attached to said upper and anterior shields by one of glue, stitching, rivets, and lacing.

9. The foot protector of claim 2 wherein said upper shield comprises one or more pairs of eyelets for a shoelace to feed through and fasten said upper shield to said shoe.

10. The foot protector of claim 2 wherein said anterior shield comprises a strap which fastens said anterior shield to said shoe.

11. The foot protector of claim 10 wherein said strap comprises hook and loop material.

12. The foot protector of claim 2 wherein the foot protector is for use with one of an athletic shoe, a non-athletic shoe, a shoe having cleats, and a shoe without cleats.

13. The foot protector of claim 1 wherein said outer layer of said upper shield, said outer layer of said anterior shield and said flexible joint exist as, and are fabricated from, a single piece of material.

14. The foot protector of claim 1 wherein said upper shield is comprised of a separate left and right shield.

15. The foot protector of claim 1 wherein said flexible joint maintains a space between said upper shield and said anterior shield when said flexible joint is not in a flexed position such that said shields are not in contact.

16. The foot protector of claim 15 wherein said space is widest at the midpoint of the connection between said upper shield and said anterior shield.

17. The foot protector of claim 15 wherein said space has an open-ended elliptical shape.

18. The foot protector of claim 1 wherein said flexible joint is a translational rotational joint.

19. The foot protector of claim 1 wherein said anterior shield comprises one or more pairs of eyelets for a shoelace to feed through and fasten said anterior shield to said shoe.

20. The foot protector of claim 19 wherein said shoelace is adapted to attach to cleats on the bottom of said shoe.

21. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint comprising a translational rotational joint that is configured to create a neutral zone at two separate locations along said joint, said neutral zones defining a pivot area about which said upper shield and said anterior shield are able to pivot, thereby allowing said foot the freedom to move in a substantially natural manner.

22. The foot protector of claim 21 wherein said foot protector substantially conforms to the top and sides of the shoe to enable said foot protector to be worn thereupon.

23. The foot protector of claim 21 wherein said upper and anterior shields are comprised of one of plastic and metal.

24. The foot protector of claim 21 whereto said flexible joint is attached to said upper and anterior shields with rivets.

25. The foot protector of claim 22 wherein said upper shield comprises one or more pairs of eyelets for a shoelace to feed through and fasten said upper shield to said shoe.

26. The foot protector of claim 21 wherein the foot protector is for use with one of an athletic shoe, a non-athletic shoe, a shoe having cleats, and a shoe without cleats.

27. The foot protector of claim 21 wherein said flexible joint maintains a space between said upper shield and said anterior shield when said flexible joint is not in a flexed position such that said shields are not in contact.

28. The foot protector of claim 21 wherein said anterior shield comprises one or more pairs of eyelets for a shoelace to feed through and fasten said anterior shield to said shoe.

29. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein said foot protector substantially conforms to the top and sides of the shoe to enable said foot protector to be worn thereupon, and wherein said anterior shield comprises a strap which fastens said anterior shield to said shoe.

30. The foot protector of claim 29 wherein said strap comprises hook and loop material.

31. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein said outer layer of said upper shield, said outer layer of said anterior shield, and said flexible joint exist as, and are fabricated from, a single piece of material.

32. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein said upper shield is comprised of a separate left and fight shield.

33. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein said flexible joint maintains a space between said upper shield and said anterior shield when said flexible joint is not in a flexed position such that said shields are not in contact, and wherein said space is widest at the midpoint of the connection between said upper shield and said anterior shield.

34. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein said flexible joint maintains a space between said upper shield and said anterior shield when said flexible joint is no(in a flexed position such that said shields are not in contact, and wherein said space has an open-ended elliptical shape.

35. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein said anterior shield comprises one or more pairs of eyelets for a shoelace to feed through and fasten said anterior shield to said shoe, and wherein said shoelace is adapted to attach to cleats on the bottom of said shoe.

36. A foot protector for use with a shoe, comprising:

an upper shield shaped to conform to, cover and protect a metatarsal region of a foot within the shoe, said upper shield adapted for attachment to the shoe;

an anterior shield shaped to conform to, cover, and protect a phalanges region of said foot within the shoe, said anterior shield adapted for attachment to the shoe;

a flexible joint connecting said upper shield to said anterior shield to enable said upper shield and said anterior shield to change orientation relative to one another as a foot and protected shoe are flexed in use, said joint comprising a translational rotational joint that is configured to enable the pivot area of said upper shield and said anterior shield to substantially coincide with the pivot area associated with the top of the shoe when said upper shield and said anterior shield are attached to the shoe, thereby allowing said foot the freedom to move in a substantially natural manner.

37. A foot protector for use with a shoe, comprising:

an upper shield shaped to conform to, cover, and protect a metatarsal region of a foot within the shoe;

an anterior shield shaped to conform to, cover, and protect a phalanges region of said foot within that shoe;

a flexible joint connecting said upper shield to said anterior shield to enable said upper shield and said anterior shield to change orientation relative to one another as a foot and protected shoe are flexed in use, said flexible joint comprising a translational rotational joint that is configured to create a neutral zone at two separate locations along said joint, said neutral zones defining a pivot area about which said upper shield and said anterior shield are able to pivot, thereby allowing said foot the freedom to move in a substantially natural manner.

38. A foot protector for use with a shoe, comprising:

an upper shield shaped to conform to, cover, and protect a metatarsal region of a foot within the shoe;

an anterior shield shaped to conform to, cover, and protect a phalanges region of said foot within the shoe;

a flexible joint connecting said upper shield to said anterior shield to enable said upper shield and said anterior shield to change orientation relative to one another as a foot and protected shoe are flexed in use, said flexible joint comprising a translational rotational joint that is configured so as to create a compression zone wherein said joint is capable of translating into itself.

39. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein a lower edge of said upper shield translates beneath a top edge of said anterior shield only when said upper shield is flexed radially forward.

40. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein a top edge of said anterior shield translates above a lower edge of said upper shield only when said anterior shield is flexed radially upward.

41. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein said flexible joint is comprised of one of a flexible fabric, nylon, and rubber.

42. A foot protector for use with a shoe, comprising:

an upper shield shaped to conform to, cover, and protect that portion of the shoe housing the metatarsal region of a foot;

an anterior shield shaped to conform to, removedly cover, and protect the toe portion of the shoe within which the phalanges region of said foot is located;

a flexible joint connecting said upper shield to said anterior shield to enable said upper shield and said anterior shield to change orientation relative to one another as a foot and protected shoe are flexed in use, said flexible joint configured to create a neutral zone at two separate locations along said joint, said neutral zones defining a pivot area about which said upper shield and said anterior shield are able to pivot, thereby allowing said foot the freedom to move in a substantially natural manner;

wherein said flexible joint is attached to said upper and anterior shields by one of glue, stitching, and lacing.

* * * * *